US006329582B1

(12) United States Patent
Catalano, Jr.

(10) Patent No.: US 6,329,582 B1
(45) Date of Patent: Dec. 11, 2001

(54) ELECTRONIC MUSICAL KEYBOARD ATTACHMENT FOR A SAXOPHONE

(76) Inventor: Frank K. Catalano, Jr., 5348 Cinema Dr. West, Hanover Park, IL (US) 60103

( * ) Notice: Subject to any disclaimer, the term of this patent is extended or adjusted under 35 U.S.C. 154(b) by 0 days.

(21) Appl. No.: 09/882,822

(22) Filed: Jun. 16, 2001

(51) Int. Cl.[7] ..... G10D 7/08
(52) U.S. Cl. ..... 84/385 R; 84/327; 84/423 R
(58) Field of Search ..... 84/743, 744, 327, 84/329, 385 R, 385 A, 380 R, 423 R

(56) References Cited

U.S. PATENT DOCUMENTS

| | | | |
|---|---|---|---|
| D. 310,090 | | 8/1990 | Stone et al. . |
| 1,615,961 | * | 9/1927 | Smith . |
| 3,034,392 | | 5/1962 | Seiller et al. . |
| 3,437,002 | * | 4/1969 | Urban et al. . |
| 4,341,146 | | 7/1982 | Massa . |
| 4,342,244 | | 8/1982 | Perkins . |
| 5,105,711 | | 4/1992 | Barnard . |
| 5,691,490 | | 11/1997 | Williams . |
| 5,736,662 | | 4/1998 | Spector . |

OTHER PUBLICATIONS

"How Much For Just The Midi?"; Oct. 1989 issue of North Texas Computer Center Newsletter, "Benchmarks".

* cited by examiner

*Primary Examiner*—Jeffrey Donels
(74) *Attorney, Agent, or Firm*—Robert F. Kemp, Esq.; John G. Premo, Esq.

(57) ABSTRACT

A device for mounting an electronic musical keyboard on a saxophone having a bell key guard mounted on a plurality of vertical posts attached to the saxophone. The device comprises a resilient support attached to the bell key guard area of a saxophone. The resilient support has a bottom, sides, and a top. There is also provided a quick release, two-piece locking latch. The first part of the latch is positioned on the top of the resilient support, while the second part of the latch is located on the bottom of the electronic musical keyboard.

10 Claims, 3 Drawing Sheets

ELECTRONIC MUSICAL KEYBOARD ATTACHMENT FOR A SAXOPHONE

BACKGROUND OF THE INVENTION

1. Field of the Invention

The invention relates to a saxophone having an electronic musical keyboard attachment.

2. Description of the Prior Art

The saxophone can be a cumbersome instrument to hold and play, making it difficult for a musician to play the saxophone while simultaneously playing an electronic musical keyboard or other instrument. Accordingly, it would be an advancement in the art if a musician would be able to play a saxophone while at the same time being able to play another instrument, or to obtain the sounds of another instrument, by playing an electronic musical keyboard capable of imitating the sounds of other instruments. The present invention described herein permits a musician to play a saxophone while simultaneously playing an attached electronic musical keyboard capable of producing various sounds.

Through the use of a musical instrument digital interface ("MIDI") connection to an electronic musical keyboard attachment, a musician is able to program a number of sounds that may be played using the keyboard. The advantage of using a MIDI connection is that both instruments can be played in real time, or live, since the use of the MIDI connection permits a musician to play the saxophone while simultaneously playing an electronic musical keyboard attachment, thereby being able to "sample," or play selected keys from the saxophone, that have been previously recorded. The use of the MIDI connection also allows a musician to play chords in real time.

The sounds are often digitally recorded on a computer, which may be connected to the electronic musical keyboard attachment using a MIDI connection. When the programmed keys are played by a musician, the sounds that have been assigned to a play through the depression of a particular key or keys on the electronic musical keyboard attachment can be played using the MIDI connection. Thus, it is possible for a musician playing a saxophone to accompany himself in real time on the saxophone, by playing prerecorded keys or chords on the electronic musical keyboard attachment using a MIDI connection. For a detailed description of MIDI connections, see the article entitled, "How Much For Just The Midi?," and the references cited therein, in the October 1989 issue of North Texas Computer Center Newsletter, "Benchmarks," which publication is incorporated herein by reference.

The prior art reveals attempts to connect electronic musical keyboards to instruments, but none to a saxophone. In addition, the prior art does not reveal the mounting system found in the present invention. Accordingly, the present invention would be an improvement to this art.

To be efficient, the electronic musical keyboard attachment should have keys of standard size, such as the keys often found on pianos or stand-alone keyboards. Also, due to the nature of the saxophone and the importance of balance to the instrument for a musician's comfort, any attachment must be lightweight and not interfere with the playing of the saxophone itself. In addition, the electronic musical keyboard attachment must be connected to the saxophone without deadening the sound quality of the saxophone.

Also, the electronic musical keyboard attachment must be conveniently located on the instrument and be capable of easy attachment and detachment from the instrument. The keys found on the electronic musical keyboard attachment should be readily visible to a musician while a musician is holding the saxophone in a normal playing position. Finally, the invention is designed for the electronic musical keyboard attachment to be played with the right hand. Since the left hand is responsible for the majority of sounds created by a saxophone, use of the right hand to play the electronic musical keyboard attachment affords a musician the greatest opportunity to play a saxophone while simultaneously playing a keyboard. The positioning of the present invention permits a saxophone to be played with the left hand while the right hand may play the electronic musical keyboard attachment.

All of these desirable qualities as stated above are provided by the invention and their incorporation into a practical working electronic musical keyboard mounting device for a saxophone represent the objects of the invention.

SUMMARY OF THE INVENTION

A device for mounting an electronic musical keyboard attachment on a saxophone having a modified bell key guard mounted on a plurality of vertical posts attached to the saxophone. The device comprises a resilient mounting pad attached to the bell key guard area of a saxophone. The resilient mounting pad has a bottom, sides, and a top. It also has a front and a back. There is also provided a quick release, two-piece locking latch. The first piece of the latch is positioned on the top of the resilient mounting pad, while the second piece of the latch is located on the bottom of an electronic musical keyboard attachment.

In a preferred embodiment, the resilient mounting pad has a bottom, sides, and a top containing a plurality of holes that communicate with a sleeve horizontally positioned below the holes in the resilient support. The plurality of holes in the top of the sleeve are aligned with the holes in the top of the resilient mounting pad. A further element is a quick release locking assembly within the sleeve for receiving and locking pins located on the bottom of an electronic musical keyboard attachment. These pins are positioned to mate with and engage the holes in the top of the resilient mounting pad and the top of the sleeve. The pins on the bottom of the electronic musical keyboard attachment are notched so as to permit the device to be easily attached to the resilient mounting pad with one hand, thereby allowing the musician to attach the keyboard quickly between songs.

Further, the resilient mounting pad is positioned above the keys of the saxophone to allow for normal playing of the keys of the saxophone. Also, the resilient mounting pad holds the keyboard angled forwardly from the vertical and inwardly tilted towards the saxophone. Preferably, the resilient mounting pad is positioned on and attached to the vertical posts and functions as a bell key guard. The invention as described actually replaces the bell key guard normally found on a saxophone. Desirably, the resilient mounting pad is made from an elastomer. Use of an elastomer helps to lessen the vibrations caused by playing the electronic musical keyboard attachment, thereby minimizing the effect on the sound quality of the saxophone itself.

Most preferably, the sleeve has a closed front end containing a spring. Also provided is a rod having front and rear ends and slideably moveable within the sleeve. The front end of the rod engages the spring.

There are a series of notches on the rod positioned to align with the holes in the resilient mounting pad and the holes in the sleeve when the spring is compressed. Also, in this embodiment, there are pins located on the bottom of an electronic musical keyboard, which pins are positioned to mate with and engage the holes in the top of the resilient mounting pad and the top of the sleeve and the notches of the sleeve when the spring is compressed. Desirably, the pins are notched where they engage the notches of the rod. The front end of the rod extends beyond the electronic musical keyboard attachment and has a handle. Further, the keyboard contains at least 12 keys and, preferably, 17 keys.

BRIEF DESCRIPTION OF THE DRAWINGS

In the drawings, like parts have like numbers.

DETAILED DESCRIPTION OF THE INVENTION

Figure 1:
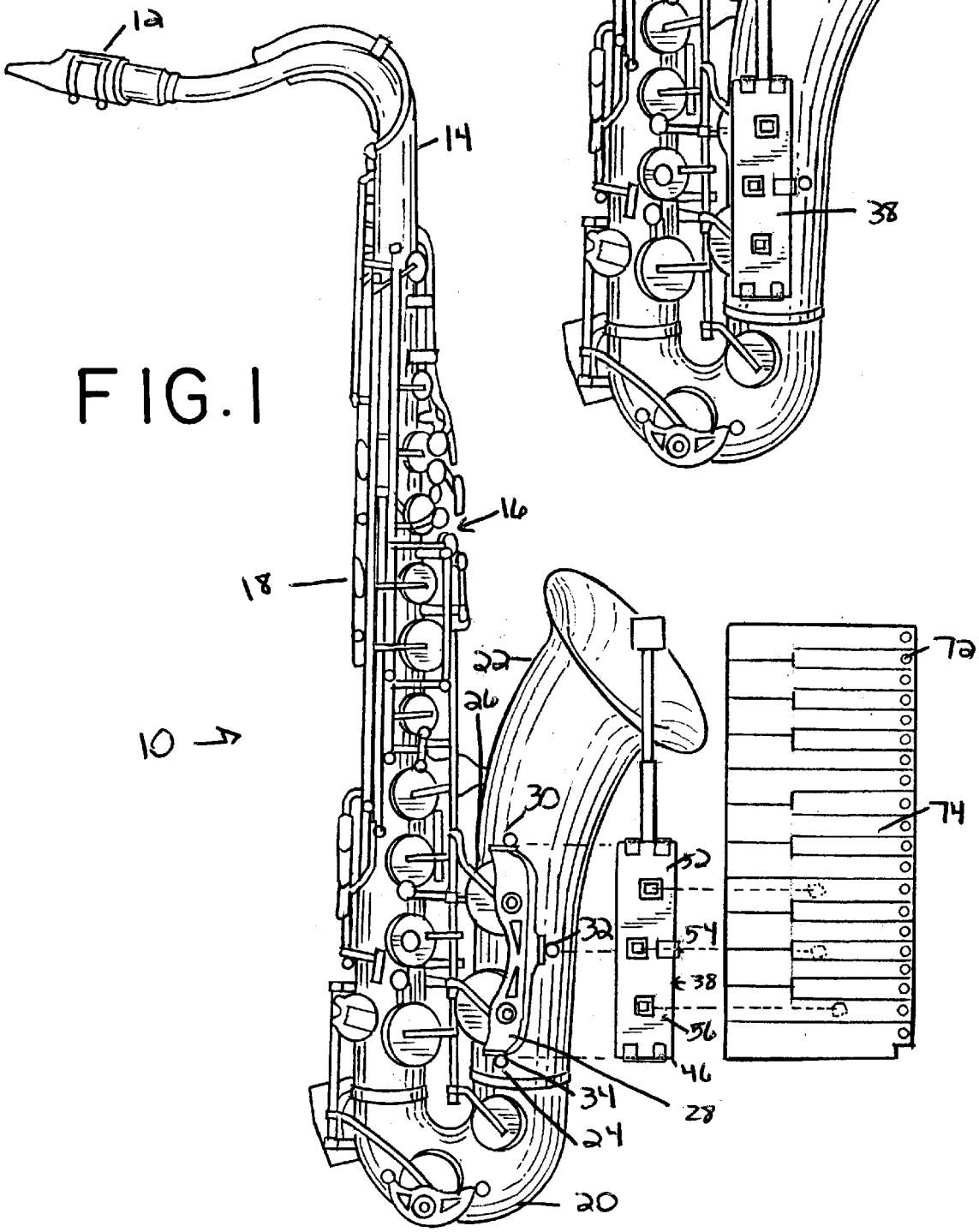
FIG. 1 is a vertical exploded view of a saxophone showing the electronic musical keyboard support and the musical keyboard.
Figure 5:
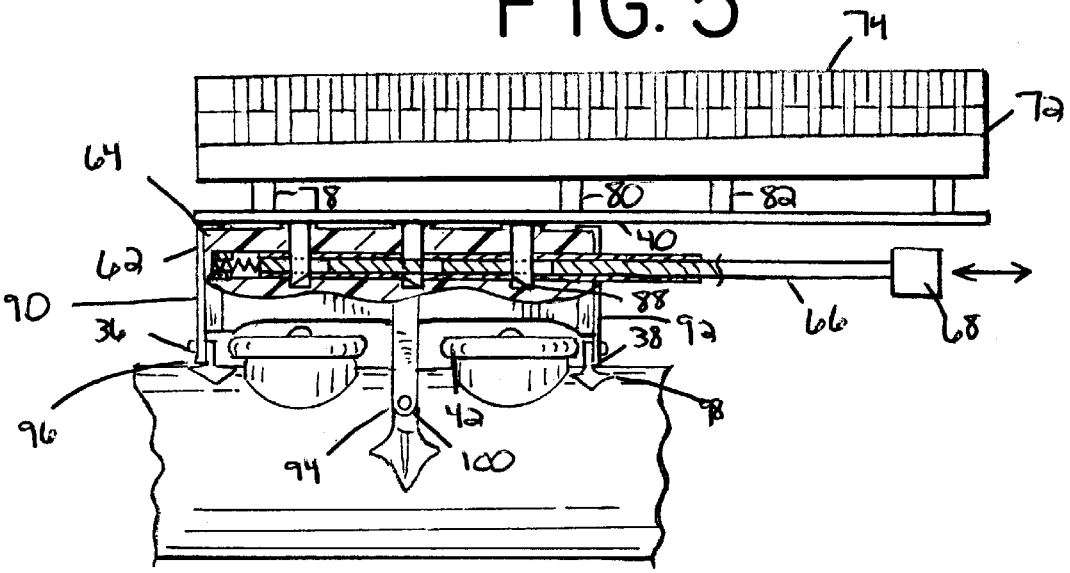
FIG. 5 is a horizontal partial view of the electronic musical keyboard mounted upon the keyboard support that contains a quick release locking latch mechanism.

In a conventional saxophone 10, shown to best advantage in FIG. 1, there is a mouthpiece 12, a neck 14, and a body 16 having three parts, namely, a body tube 18, a bow 20, and a bell 22. The bell 22 has bell keys 24 and 26 that are held in place by a bell key guard 28. The bell keys are generally responsible for the low "B" and "B flat" keys on saxophones. The bell key guard 28 is mounted upon the bell 22 by means of three vertical mounting posts 30, 32, and 34. The bell key guard 28 is held in place with screws 36 which extend through the vertical mounting posts 30, 32, and 34. This is shown to best advantage in FIG. 5.

Figure 2:
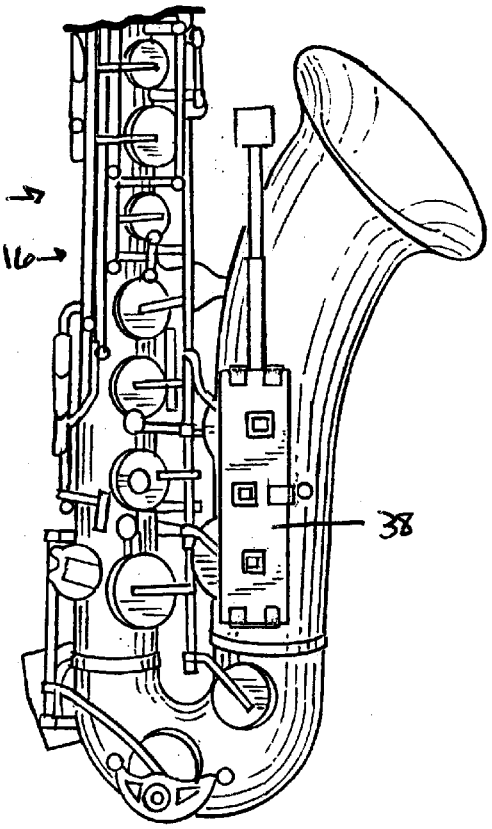
FIG. 2 is a vertical partial view of a saxophone having the electronic musical keyboard support mounted thereon.

As shown in FIG. 2, there is provided a resilient mounting pad 38 having a top 40, a bottom 42, sides 44 and 46, a front end 48, and a back end 50. In a preferred embodiment of the invention, the resilient mounting pad is made of a dense elastomer, such as natural ribber, neoprene, butadiene, or any other elastomer having similar mechanical properties. The top 40 of the resilient mounting pad 38 contains a series of three holes 52, 54, and 56. These holes 52, 54, and 56 extend into the resilient mounting pad 38 for a sufficient distance to engage a series of mating holes 52A, 54A, and 56A, located on the top of a sleeve 58 which is horizontally positioned lengthwise within the resilient mounting pad 38 near its top 40 and is the shape of an elongated rectangle.

Positioned within the sleeve 58 is a slideable rod 60. Sleeve 58 has a closed front end 62, which contains a spring 64, which is urged against closed front end 62. The slideable rod 60 has an open back end 66 fitted with a handle 68. It should be noted in FIGS. 1, 2, and 5, the handle 68 extends a substantial distance from the sleeve 58.

Figure 6:
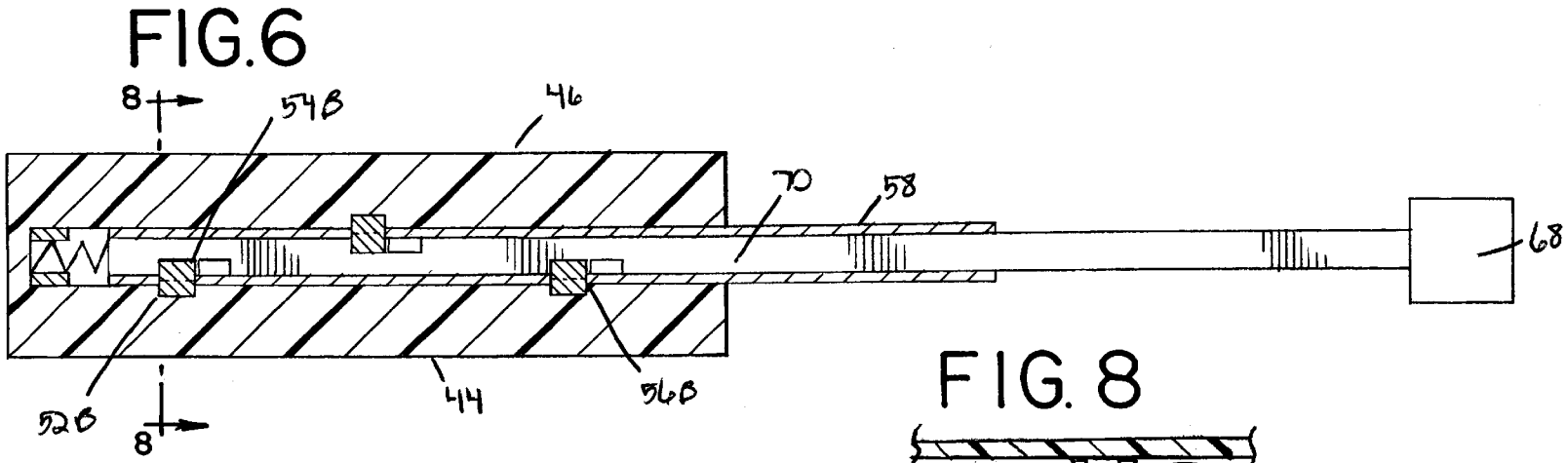
FIG. 6 is a horizontal cutaway view of the electronic musical keyboard support showing contained therein a horizontally disposed sleeve having a closed front end and an uncompressed spring within the front end, mounting holes, and a rod containing notches which is slideably moveable within the sleeve.
Figure 8:
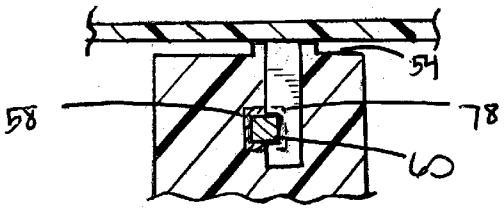
FIG. 8 is cutaway end view across the lines 8—8 of FIG. 6.
Figure 7:
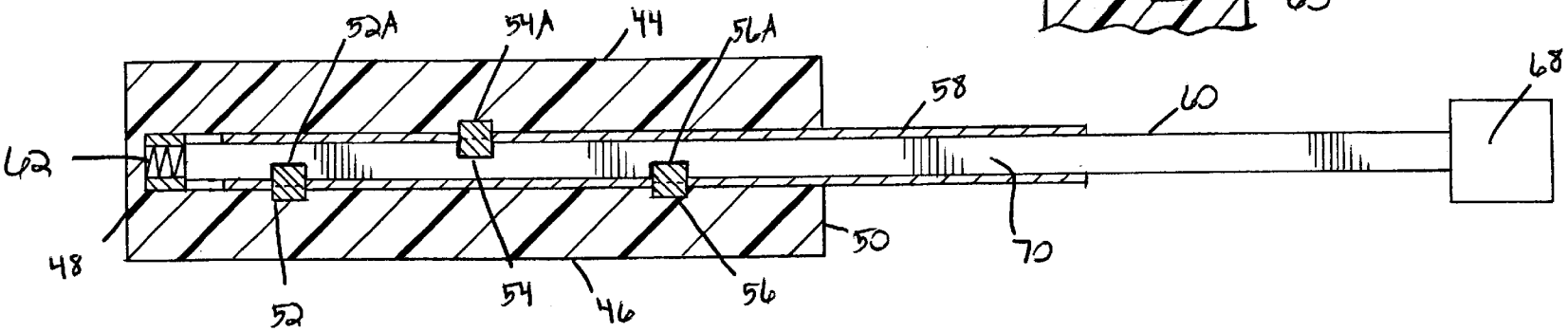
FIG. 7 is similar to FIG. 6, showing the spring in a compressed state.

As can be seen to best advantage in FIGS. 6, 7, and 8, the holes 52, 54, and 56, in the top 40 of resilient mounting pad 38, and their mating counterparts 52A, 54A, and 56A, which extend through the sleeve 58, are square in cross-section. The slideable rod 60 along the edges of its top 70 contains rectangular notches 52B, 54B, and 56B, positioned to be aligned with holes 52, 54, and 56, and their mating counterparts 52A, 54A, and 56A when the slideable rod 60 is depressed and spring 64 is compressed.

The electronic musical keyboard attachment 72 has standard piano-type keys 74. The bottom 76 of the electronic musical keyboard attachment 72 contains three pins 78, 80, and 82, mounted upon a back plate 84, which is attached to the electronic musical keyboard attachment 72 by mounting screws 86. The pins 78, 80, and 82 are dimensioned to engage and mate with holes 52, 54, and 56 in the resilient mounting pad 38 and the mating counterparts 52A, 54A, and 56A in sleeve 58. The pins 78, 80, and 82 are of sufficient length to extend into the sleeve 58 so as they may be engaged by the notches 52B, 54B, and 56B. Additionally, in a preferred mode, the pins 78, 80, and 82 near their end contain notches 88 that act to lock against the notches 52B, 54B, and 56B.

To utilize the invention, the resilient mounting pad 38 is attached to the bell 22. Any number of suitable attachment means may be used provided they do not unduly add to the weight or impair the function or damage the bell key guard 28. The attachment means should not distort the shape of the bell 22, or weaken the instrument. Also, the mounting means should not in any way impair the tonal quality of the saxophone 10. While straps, adhesives, and the like may be used, it is preferred that the resilient mounting pad 38 be dimensioned to fit within the mounting posts 32, 34, and 36 of the bell key guard 28. To achieve this mounting arrangement, the resilient mounting pad 38 is fitted with mounting straps 90, 92, and 94, which are shown to best advantage in FIG. 5. These mounting straps 90, 92, and 94 contain at their ends 96, 98, and 100 holes for engaging the holes in the mounting posts 30, 32, and 34. This is accomplished by removing screws 36 and removing the existing bell key guard 28 and replacing it with the resilient mounting pad 38 that becomes a substitute bell key guard.

Figure 3:
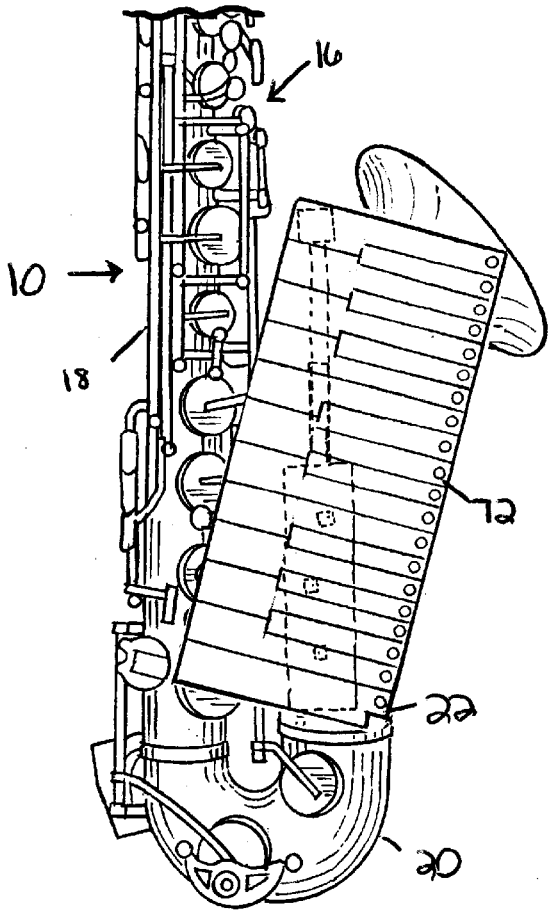
FIG. 3 is a vertical partial view of a saxophone having the electronic musical keyboard support fitted with the keyboard.
Figure 4:
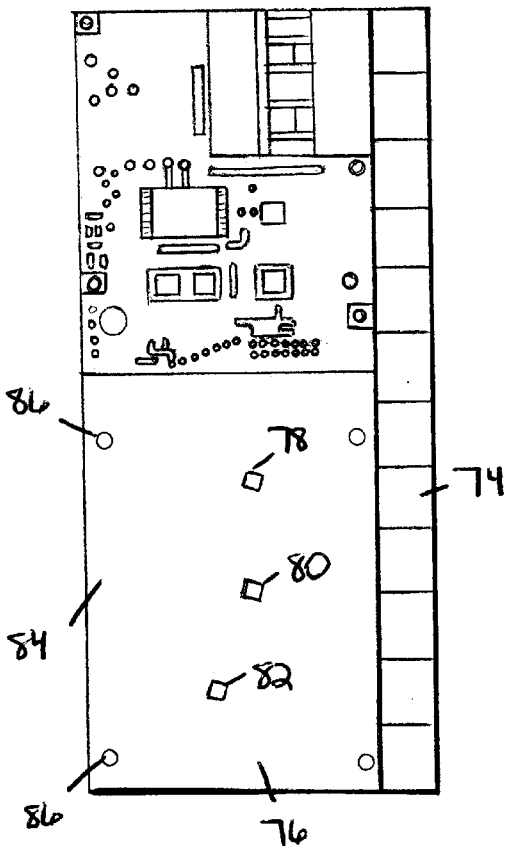
FIG. 4 is a vertical bottom view of the electronic musical keyboard.

As shown to best advantage in FIG. 3, the electronic musical keyboard attachment 72 is positioned so that the keyboard 72 is forwardly angled from the vertical. Typical of this angle would be between 20–30 degrees. In addition to this vertical pitch, the electronic musical keyboard attachment 72 is tilted inwardly towards the saxophone 10. Typical of this angle would be between 5–10 degrees. To achieve the vertical angle, the mounting holes 52, 54, and 56 are staggered in accordance with the angle desired. To achieve the inward tilt, the mounting straps are positioned so as to achieve the inward tilt at the desired angle.

To install and remove the electronic musical keyboard attachment 72 from the saxophone containing the resilient mounting pad 38, rod 60 is pressed into the sleeve 58, compressing spring 62, which makes all of the openings in the unit in alignment. The mounting pins 78, 80, and 82, are inserted into holes 52, 54, and 56, and the slideable rod 60 is released, compressing spring 62 and locking the notches 88 against the mounting pins 78, 80, and 82. To quickly remove the electronic musical keyboard attachment 72 from the resilient mounting pad 38, a handle 68 of slideable rod 60 is depressed and compresses spring 62. This disengages the notches 88 from the mounting pins 78, 80, and 82, thus allowing nearly instant removal. To allow quick access to the operation of the slideable rod 60, the slideable rod 60 is elongated and extends slightly above the bell 22, thus making it readily accessible for nearly instant removal or attachment of the electronic musical keyboard attachment 72.

While the above has set forth the best mode of the invention, it is susceptible to obvious modification. The resilient mounting pad 38 may be replaced by a simple metal or rigid plastic rectangular sheet that could be spring mounted or magnetized on to the mounting posts 30, 32, and 34. It is important to note that the resilient mounting pad 38 is so dimensioned and raised that it allows for easy and convenient playing of the keys.

For optimal utilization of the invention, the electronic musical keyboard attachment 72 should contain 12 keys, and preferably 17 keys. Such a keyboard is readily obtainable by trimming a standard electronic musical keyboard and reattaching the necessary wiring. The keyboard is conventional in that it contains a MIDI connection (not shown).

Having thus described my invention, I claim as follows. I claim:

1. A device for mounting an electronic musical keyboard on a saxophone having a bell key guard mounted on a plurality of vertical posts attached to the saxophone comprising:

a resilient support attached to the bell key guard area of a saxophone, which resilient support has a bottom, sides, and a top; and, a quick release two-piece locking latch, with the first piece of the latch being on the top of the resilient support and the second piece of the latch being located on the bottom of the electronic musical keyboard.

2. A device for mounting an electronic musical keyboard on a saxophone having a bell key guard mounted on a plurality of vertical posts attached to the saxophone comprising:

a resilient support attached to the bell key guard area of a saxophone, which resilient support has a bottom, sides, and a top, containing a plurality of holes which communicate with:

a sleeve, horizontally positioned below the holes in the resilient support;

a plurality of holes in the top of the sleeve aligned with the holes in the top of the resilient support; and a quick release locking assembly within the sleeve for receiving and locking pins located on the bottom of a musical keyboard, which pins are positioned to mate with and engage the holes in the top of the resilient support and the top of the sleeve.

3. The device of claim 2, where the resilient support is positioned above the keys of the saxophone to allow for normal playing of the keys of the saxophone.

4. The device of claim 2, where the resilient support holds the keyboard angled forwardly from the vertical and inwardly tilted towards the saxophone.

5. The device of claim 2, where the resilient support is mounted on the vertical posts and functions as a key guard.

6. The device of claim 2, where the resilient support is made from an elastomer.

7. A device for mounting an electronic musical keyboard on a saxophone having a bell key guard mounted on a plurality of vertical posts attached to the saxophone comprising:

a resilient support attached to the bell key guard vertical posts of a saxophone, which resilient support has a bottom, sides, and a top containing a plurality of holes which communicates with:

a sleeve, having a closed front end containing a spring, horizontally positioned below the resilient support;

a plurality of holes in the top of the sleeve aligned with the holes in the top of the resilient support;

a rod having front and rear ends slideably moveable within the sleeve, with the front of the rod engaging the spring;

a series of notches on the rod positioned to align with the holes in the resilient support and the holes in the sleeve when the spring is compressed; and, pins located on the bottom of an electronic musical keyboard, which pins are positioned to mate with and engage the holes in the top of the resilient support the top of the sleeve and the notches of the sleeve when it compresses the spring.

8. The device of claim 7, where the pins are notched where they engage the notches of the rod.

9. The device of claim 7, where the front end of the rod extends beyond the keyboard and has a handle.

10. The device of claim 7, where the keyboard contains at least 12 keys.

* * * * *